United States Patent [19]

Niedermaier et al.

[11] Patent Number: 4,617,864

[45] Date of Patent: Oct. 21, 1986

[54] CYLINDER WITH INTERNAL HEAT EXCHANGE COILS TO HANDLE CONTINUOUS WEBS

[75] Inventors: Arnold Niedermaier, Beidersheim; Peter Maier, Worms, both of Fed. Rep. of Germany

[73] Assignee: Albert-Frankenthal AG, Frankenthal, Fed. Rep. of Germany

[21] Appl. No.: 774,350

[22] Filed: Sep. 10, 1985

[30] Foreign Application Priority Data

Oct. 25, 1984 [DE] Fed. Rep. of Germany ..... 3439090

[51] Int. Cl.[4] ..... B41F 5/04; F28D 11/02

[52] U.S. Cl. ..... 101/219; 165/90

[58] Field of Search ..... 101/216, 219, 349, 141, 101/174, 205–206; 165/89–91; 34/124; 100/93 R; 308/116.14, 85 B

[56] References Cited

U.S. PATENT DOCUMENTS

| | | | |
|---|---|---|---|
| 630,727 | 8/1899 | Muller | 165/90 |
| 695,041 | 3/1902 | Fues | 165/89 H |
| 1,672,036 | 6/1928 | Oltman | 165/89 H |
| 3,064,563 | 11/1962 | Cook | 101/216 |
| 3,425,488 | 2/1969 | Jarreby | 165/90 |
| 3,473,603 | 10/1969 | Fujie | 165/90 X |
| 3,704,669 | 12/1972 | Christoff | 101/216 |
| 4,093,023 | 6/1978 | Frantsenjuk et al. | 165/89 |
| 4,351,386 | 9/1982 | Kobler | 165/89 |
| 4,440,214 | 4/1984 | Wedel | 165/90 |
| 4,501,955 | 2/1985 | Bick | 165/90 |

FOREIGN PATENT DOCUMENTS

| | | | |
|---|---|---|---|
| 1222213 | 6/1960 | France | 165/90 |
| 135665 | 10/1980 | Japan | 101/216 |
| 21001 | of 1914 | United Kingdom | 165/90 |
| 715 | of 1914 | United Kingdom | 165/90 |

*Primary Examiner*—E. H. Eickholt

*Attorney, Agent, or Firm*—Collard, Roe & Galgano

[57] ABSTRACT

A cylinder for handling continuous lengths of web material comprises a rotatably mounted tubular casing, a spindle extending from end to end of the casing and arranged to be stationary in relation to rotation of said casing and having an external diameter less than the diameter of an inner face of the tubular casing, at least one support bearing which is symmetrical in relation to the middle of the cylinder and coaxial to the cylinder, the bearing bridging over an annular space existing between the casing and the spindle, oil at least partly filling the annular space, at least one heat exchanger placed in the annular space and surrounding the spindle, mounts fixed to the spindle for locating the heat exchanger thereon, and connection ducts for coolant, at least partly in the form of lengths of flexible hose placed in recesses in the spindle, the connection ducts being adapted to join the heat exchanger with an external coolant supply and return duct.

11 Claims, 1 Drawing Figure

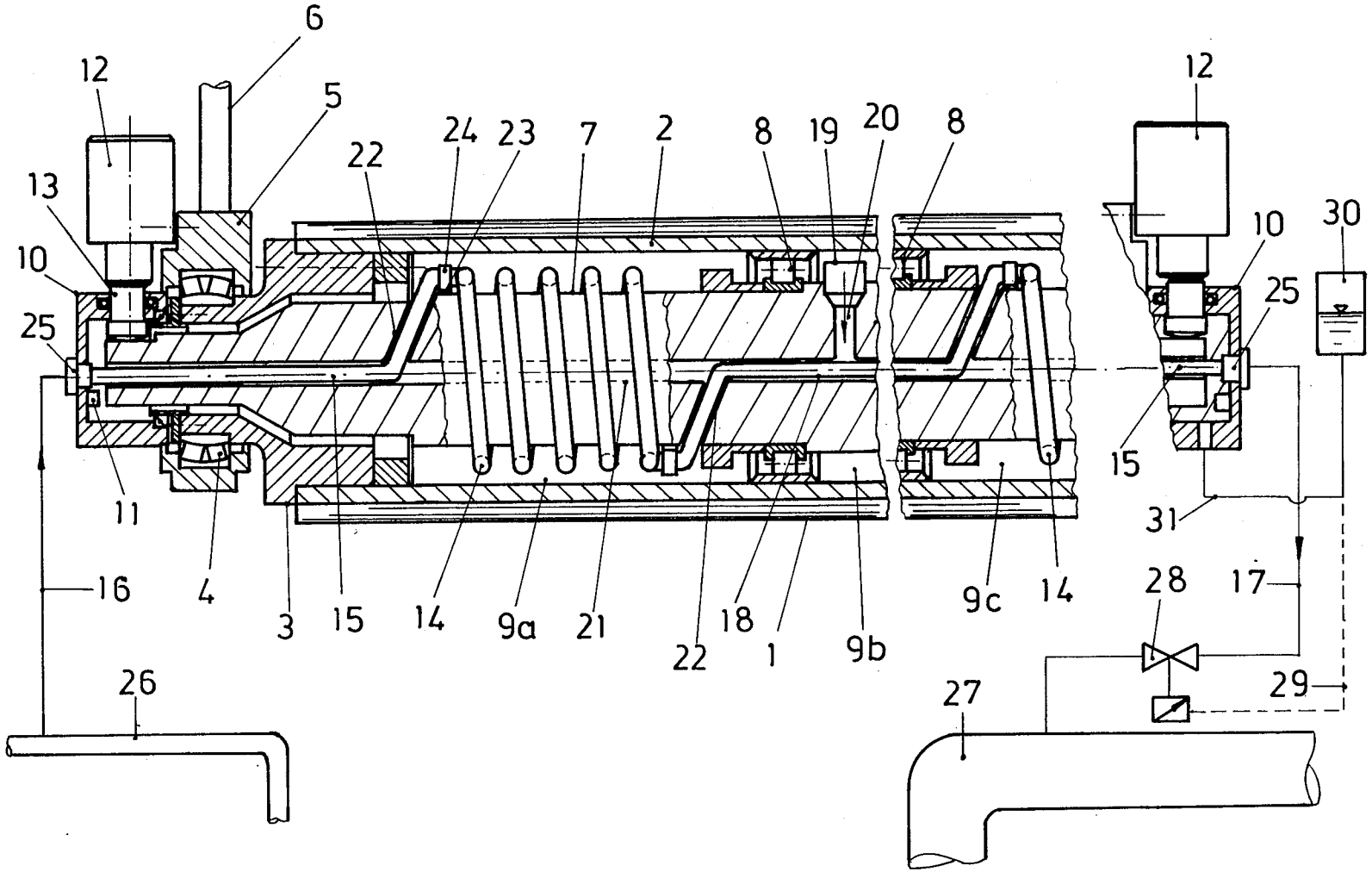
30
29
25
10
17
12
31
28
15
14
9c
27
8
20
9b
19
1
8
18
22
2
21
7
9a
23
24
14
22
15
6
5
3
4
12
11
26
16
13
10
25

CYLINDER WITH INTERNAL HEAT EXCHANGE COILS TO HANDLE CONTINUOUS WEBS

BACKGROUND OF THE INVENTION

The invention relates to cylinders for use in a machine handling continuous lengths of web material and more especially but not exclusively to an impression cylinder for a rotogravure printing press, comprising a tubular casing to be supported by respective bearings at the sides of the machine and which contains a non-rotary spindle having an external diameter which is smaller than the internal diameter of the casing and being connected with the casing by way of at least one support bearing which is symmetrically placed in relation to the length of the cylinder and is coaxial in relation to it, such support bearing furthermore spanning an annular space which is between the spindle and the casing and serves to contain an oil filling which at least partly fills the space.

A cylinder having these features has been previously proposed in the German Auslegeschrift specification No. 3,114,731, whose oil filling was however to be stationary and was only intended to ensure equalisation of temperature along the length of the cylinder and prevent local hot spots on its casing. Cooling of the cylinder casing and thus of the covering on it would not have been possible with such a system. In the previously proposed arrangement there was a limitation of the permissible speed of rotation of the cylinder to a value very much lower than the speed of 50,000 revolutions per hour as required for modern rotogravure presses, this being because high speeds of revolution led to considerable internal friction in the core of the rubber cover of the cylinder above the temperature limit specified therefor so that there was an unfavorable effect on the length of life of the rubber cover.

SHORT SUMMARY OF THE INVENTION

Taking this state of the art as a starting point it is accordingly one object of the present invention to devise a cylinder of the sort initially mentioned which provides for a reliable cooling down of the oil using simple means so that there is a comparatively low and even core temperature of the rubber cylinder cover on the rotating casing and even at comparatively high speeds of revolution one may expect a long working life of the rubber cover.

In order to achieve these or other objects that will appear in the course of the following account, in the arrangement of the present invention there is at least one heat exchanger placed in the annular space between the spindle and the casing, such exchanger being mounted on mounts secured to the spindle and connected by means of connection ducts, which at least in part are in the form of flexible hose, running through associated recesses in the spindle, with an external coolant supply and return ducts.

It will be seen from this aspect of the invention that there is the advantage of having the heat exchanger integrated in the cylinder structure. An internal heat exchanger of the type specified offers the possibility of making an extreme reduction in the temperature differences by having a high heat exchange fluid flow rate, something that furthermore leads to a favorable effect on ensuring the most even possible oil temperature along the length of the cylinder. The coolant flowing through the heat exchanger may in such a case simply be taken from some already existing piped supply system such as a water supply system, flowing into the supply end of the heat exchanger. There is the advantage that no system for producing a forced circulation is needed. Owing to the fact that the heat exchanger is on mounts placed on the spindle and that the supply ducts running through recesses in the spindle are made at least in part of flexible hose, it is possible to be sure that relative motion within the ducts associated with the heat exchanger mounted on the spindle due to bending of the spindle or of the casing bending in relation thereto is able to be allowed for without any parts being subjected to excessive strains.

In accordance with an advantageous form of the invention the heat exchanger or exchangers may take the form of a tube or tubes coiled around the spindle. This leads to a simple structure of the heat exchanger and an economic use of the space available by the arrangement, while at the same time having a relatively large heat exchange area.

As part of a still further development of the invention it is possible to have two heat exchangers separated from each other by the support bearing or bearings. There is then the benefit that this makes possible a structure that is symmetrical in relation to the middle of the cylinder and it has an advantageous effect as regards obtaining the most even possible oil temperature along the full length of cylinder. As part of a still further outgrowth of this principle it is possible for the two heat exchangers to be connected in series fluidwise, for example by having a connecting duct shunted across the support bearing or bearings and extending through a recess in the spindle. These measures lead to the advantage of a very simple design, while nevertheless it is possible to ensure a high coolant flow rate and an almost constant surface temperature throughout the heat exchanger arrangement.

In accordance with a further and particularly advantageous development of the invention it is possible to provide oil strippers in the part of the annular space not occupied by the heat exchanger and fixed to the spindle so as to extend therefrom radially as far as the casing, there being associated spindle recesses leading to an associated heat exchanger. The oil supply by the oil strippers to the associated spindle recesses is in this case pumped via such recesses to a heat exchanger. Owing to the centrifugal force produced on rotation of the casing there is then automatically an equalisation of the oil level and therefore a return of the oil. The oil circulation produced by such a design has a favorable effect as regards obtaining the most even oil temperature possible, even that is, along the full length of the cylinder.

As part of a further advantageous form of the invention, the connection ducts for the heat exchangers may take the form of flexible lengths of hose extending for their full length through the associated spindle recesses. This design simplifies assembly and results at the same time in the desired flexible connection between the coolant supply and drain ducts that have to be stationary, and the connection ducts to be placed on the spindle so that there is no reduction in the mobility of the spindle.

It is convenient for the hose section to have a size less than that of the spindle recess therefor. This makes possible the simultaneous use of these spindle recesses for circulation of the oil.

Further useful developments of the invention will appear from the following account of one possible form of it to be seen in the FIGURE.

The single FIGURE of the drawing is a longitudinal section of an impression cylinder for a rotogravure printing press, the cylinder being fitted with heat exchangers.

DETAILED ACCOUNT OF WORKING EXAMPLE OF THE INVENTION

Since the general design and workings of a rotogravure press will be familiar to the reader, no extensive description thereof will be embarked upon in the present instance. The impression cylinder shown in the drawing consists of a tubular casing 2 fitted with a rubber cover 1 and supported at its two ends by means of end trunnions 3, which have a hole coaxial in relation to the bore of the casing and are received in self-aligning bearings 4 mounted on lateral bearers 5. The bearers 5 are acted upon by cylinder actuators 6 with whose aid the impression cylinder is moved towards and pressed against the associated cylinder and it may be moved clear of it by such means. Within the tubular casing 2 there is a spindle 7 extending through it from end to end and having an external diameter which is less than the inner diameter of the casing and the holes in the trunnions 3. The spindle, which does not rotate, has two support bearings 8, that are coaxial in relation to the impression cylinder and are placed symmetrically in relation to the middle of the impression cylinder. The support bearings 8 are clamped between a collar on the spindle on one side of each bearing 8 and a bush having a split clamping ring and being itself clamped on the spindle 7. The support bearings 8 divide the annular space between the spindle 7 and the casing 2 into three separate chambers 9*a*, 9*b* and 9*c*.

The spindle 7 is longer than the casing 2 having the end trunnions 3 so that the ends of the spindle 7 project past the ends of the trunnions 3. The ends of the spindle 7 extending beyond the end trunnions 3 are encompassed in each case by a cover cap 10, such caps 10 being screwed to the respective adjacent bearer 5. To locate the spindle 7 in the axial direction the caps 10 are made with internal abutments 11. To seal off the self-aligning bearings 4 from the space inside the caps 10 there is in each case a seal, allowing relative motion, between the inwardly turned radial faces of the caps 10 and the respectively adjacent trunnion 3, such seal being for example in the form of a radial packing or other shaft seal.

In order to correct flexure of the impression cylinder there are actuators 12 in the form of piston and cylinder units designed to act on the spindle ends extending from the casing and able to move in a radial direction in relation to the axis of the impression cylinder. These actuators are respectively joined to the bearers 5 next to them. The caps 10 each have a radial hole in their cylindrical parts to allow the passage of the respective actuator, whose end extends into and through it in the form of a plunger. In the illustrated working example of the invention the actuators 12 have respective plungers 13 fitted into the respective cap 10. The outer ends of such plungers 13 are engaged by the piston rod of the respective actuator.

Owing to the internal friction in the rubber cover 1 a substantial amount of heat is produced on each revolution of the impression cylinder. Furthermore owing to bearing friction at the support bearings 8 there will be a local production of heat. In order nevertheless to keep the surface temperature and the core temperature of the rubber cover 1 within rated limits and to ensure equalisation of temperature along the full length of the impression cylinder, the annular space 9 is partly filled with oil, which for its part is continuously cooled. To do this there is at least one heat exchanger 14 attached to the spindle 7 in the annular space 9, the heat exchanger being so placed that its surface dips into the oil filling which is slung out by centrifugal force against the bore of the casing 2 during rotation of same and which is connected via suitable ducts 15 on the impression cylinder with respective stationary coolant supply and drain or return ducts 16 and 17, respectively placed outside the impression cylinder. The connection ducts 15 are located in recesses in the spindle.

In the present working example of the invention there are two heat exchangers 14 which are accommodated in the two outer annular chambers 9*a* and 9*c*, respectively. These two heat exchangers 14 may be connected fluidwise in parallel and to make this possible the heat exchangers 14 are connected with each other by a linking duct 18 spanning or bridging over the middle annular chamber between the support bearings 8. The linking duct 18 is placed in a recess in the spindle for it so that it is out of the way of the support bearings 8. At the middle annular chamber 9*b* there are vanes 19 which are anchored on the spindle and extend away from it so that their outer ends reach as far as the casing 2. When the casing 2 is rotating these vanes dip into the oil which is flung against the bore of the casing 2 in an annular layer and so act as strippers. The vanes 19 are placed adjacent further recesses in the spindle which provide a connection for flow between the parts of the annular space 9 having the vanes 19 and the parts thereof with the heat exchangers 14 therein. During operation the oil, stripped by the vanes 19 and conducted thereby radially inwards, is pumped into the parts of the annular space with the heat exchangers. Owing to the equalisation of level caused by centrifugal force there is an automatic return flow of oil via the support bearings 8, which here are constructed as anti-friction bearings. This circulation of oil leads to a satisfactory equalisation of temperature while at the same time ensuring good lubrication of the bearings.

The connection ducts 15 and the linking duct 18 may simply be in the form of lengths of flexible hose laid in the appropriate spindle recesses. The flexibility of the lengths of hose facilitates introducing them into their recesses in the spindle. At the same time this provides a flexible connection between the heat exchanger 14 fixed on the spindle 7 kept in place by the actuators 12 and the stationary supply and drain ducts 16 and 17, respectively. The sections of hose forming the connection and linking ducts 15 and 18 in the present case are made smaller in diameter than the recess in the spindle so that there is a clearance between them. This ensures that the circulation of oil induced by the vanes 19 may proceed via the recesses for linking duct 18 and/or the connection ducts 15 in the spindle. For this purpose the recesses have radial branches 20 opening adjacent the vanes 19.

The recesses in the spindle 7 are in the present example of the invention in the form of a centrally placed axial through hole 21 from which in front and behind each heat heat exchanger 14 there extend radially opening radial holes 22 serving to take up the end parts, adjacent to the heat exchanger, of the hose lengths forming the connection and linking ducts 16 and 18, and branch ducts 20 associated with the vanes 19. The radial holes 22 associated with the connection ducts 15 and the linking duct 18 are placed at an angle in relation to the spindle axis, this being to facilitate the introduction of the lengths of hose, forming the connection ducts 15 and the linking duct 18. It would also be possible for the recesses in the spindle to take the form of ducts so that it would then be only necessary to have connectors joining with the ends of the recesses in the spindle. The use of lengths of hose situated in the recesses in the spindle however facilitates the production of recesses in the spindle and the fitting of the ducts in place.

In order to attach the heat exchanger 14 on the spindle 7 there are mounts 23 fixed thereto, which are provided with a tube connector 24 for making a screw joint between the adjacent ends of a connection duct 15 or a linking duct 18 and the end of a heat exchanger 14. The hose lengths forming the connection ducts 15 and projecting from the spindle ends from the axial hole 21, are screwed to the coolant supply duct 16 and the coolant drain duct 17 at the caps 10. To make this possible the tube connectors 25 mounted in the caps 10 are used. The ends, extending beyond the spindle 7, ensure the desired degree of mobility required to keep up with bending of the spindle.

Water may be used as the coolant. Coolant water is available at many printers from a piped system with a certain delivery pressure and with a central cooling station. If this is not the case, it is possible to use normal water from a pipe of a drinking water supply system. The coolant supply duct 16 is accordingly in the form of a tapping duct for connection with such a supply pipe system 26. The pipe pressure will in this case be sufficient to ensure a sufficient flow of coolant at the heat exchanger 14. The coolant drain or return duct 17 opens into a drain pipe 27 leading to a central cooling station, or, in the case of the use of normal tap water, to a drain. To ensure maximum equalisation of temperature of the oil present in the annular space 9 there is a thermostatic valve 28 in the coolant drain duct 17, which regulates the rate of coolant flow as a function of the coolant temperature or, as in the present case, as a function of the oil temperature. For this purpose there is a sensor 29 for the oil temperature. In order to keep the oil level in the annular space 9 at the required position and to prevent a gage pressure building up in the annular space 9, there is an oil compensating container 30 outside the impression cylinder, which is connected via a duct 31 with the annular space 9. The duct 31 is screwed to a pipe union placed at one of the caps 10.

The spindle 7 and the parts to be placed thereon in the form of the support bearings 8, the heat exchangers 17 and the mounts 23 associated therewith together with the vanes 19 form practically a subassembly which may be mounted as such. It is only after the assembly and fitting together of these parts that the casing 2 is pushed into place and all the bearing means mounted. The integration of the heat exchangers 14 in the impression cylinder does not have any undesired effects as regards assembly.

What is claimed is:

1. A cylinder for handling continuous lengths of web material comprising a tubular casing, bearers at ends of such casing for supporting same rotatably, a spindle arranged to be stationary in relation to rotation of said casing and having an external diameter less than the diameter of an inner face of said tubular casing, said spindle extending continuously through said casing from end to end thereof, a support bearing means which is symmetrical in relation to the middle of the cylinder and coaxial to said cylinder, said bearing means bridging over an annular space existing between said casing and said spindle, oil at least partly filling said annular space, two to five heat exchangers placed in said annular space and surrounding said spindle, said heat exchangers being connected with each other fluidwise by means of a connection duct running through a recess in the spindle and bridging over the support bearing means, mounts fixed to said spindle for locating said heat exchangers thereon, and connection ducts for coolant, at least partly in the form of lengths of flexible hose placed in recesses in said spindle, said coolant connection ducts being adapted to join said heat exchangers with an external coolant supply and return duct.

2. The cylinder as claimed in claim 1 wherein the heat exchangers are in the form of coiled pipes.

3. The cylinder as claimed in claim 1 comprising covering caps sealingly engaging ends of said casing and overlapping ends of said spindle, and respective tube connectors mounted in said caps for connecting said coolant supply and return ducts with respective connection ducts.

4. The cylinder as claimed in claim 1 wherein at least in between one cap and an adjacent end of said spindle the connection ducts are each in the form of a flexible length of hose.

5. The cylinder as claimed in claim 1 wherein said heat exchangers are connected fluidwise with each other in series.

6. The cylinder as claimed in claim 1 wherein said connecting and linking ducts are all in the form of flexible lengths of hose extending through recesses in the spindle therefor, at least the duct linking the ends of two such heat exchangers having an external diameter less than the recess in said spindle in which same is fitted.

7. The cylinder as claimed in claim 1 wherein said coolant supply duct is connected with a pipe system supplying coolant under pressure.

8. The cylinder as claimed in claim 1 comprising a thermostatic choke valve in the said coolant return duct.

9. The cylinder as claimed in claim 8 wherein said thermostatic valve is adapted to respond to the temperature of said oil.

10. A cylinder for handling continuous lengths of web material comprising a tubular casing, bearers at ends of such casing for supporting same rotatably, a spindle arranged to be stationary in relation to rotation of said casing and having an external diameter less than the diameter of an inner face of said tubular casing, said spindle extending continuously through said casing from end to end thereof, a support bearing means which is symmetrical in relation to the middle of the cylinder and coaxial to said cylinder, said bearing means bridging over an annular space existing between said casing and said spindle, oil at least partly filling said annular space, at least two heat exchangers placed in said annular space and surrounding said spindle, mounts fixed to said spindle for locating said heat exchangers thereon, connection ducts for coolant, at least partly in the form of lengths of flexible hose placed in recesses in said spindle, said connection ducts being adapted to join said heat exchangers with an external coolant supply and return duct, oil strippers attached to the spindle in a part of said annular space free of heat exchanger and extending radially from the spindle as far as a position adjacent to the casing, and a linking duct connecting said at least two heat exchangers with each other and wherein said spindle has a central axial hole extending therethrough and having radial holes extending therefrom associated with said oil strippers and receiving said connection and linking ducts.

11. The cylinder as claimed in claim 10 wherein radial holes receiving the connecting ducts and the linking duct present in said spindle are at an angle to the axis thereof.

* * * * *